US011286948B2

(12) United States Patent
Hilgenberg et al.

(10) Patent No.: US 11,286,948 B2
(45) Date of Patent: Mar. 29, 2022

(54) SINGLE-SHAFT TURBO COMPRESSOR

(71) Applicant: Siemens Energy Global GmbH & Co. KG, Munich (DE)

(72) Inventors: Frederic Hilgenberg, Essen (DE); Dieter Nass, Moers (DE)

(73) Assignee: SIEMENS ENERGY GLOBAL GMBH & CO. KG, Munich (DE)

( * ) Notice: Subject to any disclaimer, the term of this patent is extended or adjusted under 35 U.S.C. 154(b) by 415 days.

(21) Appl. No.: 16/330,856

(22) PCT Filed: Aug. 22, 2017

(86) PCT No.: PCT/EP2017/071100
§ 371 (c)(1),
(2) Date: Mar. 6, 2019

(87) PCT Pub. No.: WO2018/050404
PCT Pub. Date: Mar. 22, 2018

(65) Prior Publication Data

US 2021/0285461 A1 Sep. 16, 2021

(30) Foreign Application Priority Data

Sep. 15, 2016 (DE) ..... 10 2016 217 672.2

(51) Int. Cl.
*F04D 29/42* (2006.01)
*F04D 29/054* (2006.01)
(Continued)

(52) U.S. Cl.
CPC ..... *F04D 29/4206* (2013.01); *F04D 29/054* (2013.01); *F04D 29/056* (2013.01);
(Continued)

(58) Field of Classification Search
CPC .. F04D 29/4206; F04D 29/083; F04D 29/054; F04D 29/603; F04D 29/122;
(Continued)

(56) References Cited

U.S. PATENT DOCUMENTS 3,020,053 A * 2/1962 Donald ..... F16J 15/441 277/422
5,683,235 A 11/1997 Welch
(Continued)

FOREIGN PATENT DOCUMENTS

CN 87212526 U 9/1988
CN 2205461 Y 8/1995
(Continued)

OTHER PUBLICATIONS

International search report and written opinion dated Oct. 26, 17, for corresponding PCT/EP2017/071100.

*Primary Examiner* — Kenneth J Hansen
*Assistant Examiner* — David N Brandt

(57) ABSTRACT

A single-shaft turbo compressor having a rotor extending along an axis, an outer housing, static flow fittings, bearings for supporting the rotor, and at least one first shaft seal, wherein the rotor has a shaft and an impeller arranged on the shaft, wherein the static flow fittings have supply elements, intermediate elements and discharge elements, and wherein the outer housing has a casing part that is open at the end on both sides. A first cover of the outer housing is connected to a first shaft seal, wherein supply lines and discharge lines of the first shaft seal are provided extending through the first cover into a wall thickness of the casing part adjacent to the first cover.

13 Claims, 8 Drawing Sheets

(51) Int. Cl.

| | |
|---|---|
| ***F04D 29/056*** | (2006.01) |
| ***F04D 29/08*** | (2006.01) |
| ***F04D 29/10*** | (2006.01) |
| ***F04D 29/12*** | (2006.01) |
| ***F04D 29/60*** | (2006.01) |
| ***F04D 1/08*** | (2006.01) |
| ***F04D 17/12*** | (2006.01) |
| ***F04D 29/044*** | (2006.01) |

(52) U.S. Cl.
CPC ..... *F04D 29/083* (2013.01); *F04D 29/102* (2013.01); *F04D 29/122* (2013.01); *F04D 29/603* (2013.01); *F04D 1/08* (2013.01); *F04D 17/125* (2013.01); *F04D 29/044* (2013.01)

(58) Field of Classification Search
CPC .... F04D 29/056; F04D 29/102; F04D 29/053; F04D 29/08; F04D 29/601; F04D 29/12; F04D 17/08; F04D 17/122; F04D 1/06; F04D 17/125; F04D 1/08; F04D 29/044; F04D 29/10
See application file for complete search history.

(56) References Cited

U.S. PATENT DOCUMENTS

| | | | | |
|---|---|---|---|---|
| 5,718,560 | A * | 2/1998 | Lorenzen | F16J 15/3404 415/47 |
| 9,494,165 | B2 | 11/2016 | Markwalder et al. | |
| 2013/0062832 | A1 | 3/2013 | Manninen | |
| 2015/0300366 | A1* | 10/2015 | Freeman | F04D 17/125 415/203 |
| 2018/0172015 | A1* | 6/2018 | Manzari | F04D 29/0413 |

FOREIGN PATENT DOCUMENTS

| | | | |
|---|---|---|---|
| CN | 2237133 | Y | 10/1996 |
| CN | 201121590 | Y | 9/2008 |
| CN | 101555889 | A | 10/2009 |
| CN | 201428625 | Y | 3/2010 |
| CN | 103398012 | A | 11/2013 |
| CN | 105351207 | A | 2/2016 |
| CN | 205207215 | U | 5/2016 |
| CN | 205297940 | U | 6/2016 |
| DE | 69629615 | T2 | 6/2004 |
| DE | 102008013433 | A1 | 9/2009 |
| DE | 102014207461 | A1 | 10/2015 |
| DE | 102014218941 | A1 | 3/2016 |
| WO | 2012038398 | A1 | 3/2012 |
| WO | 2015158905 | A1 | 10/2015 |
| WO | 2016026825 | A1 | 2/2016 |
| WO | 2016041800 | A1 | 3/2016 |
| WO | 2016041841 | A1 | 3/2016 |
| WO | 2016042004 | A1 | 3/2016 |

* cited by examiner

SINGLE-SHAFT TURBO COMPRESSOR

CROSS REFERENCE TO RELATED APPLICATIONS

This application is the US National Stage of International Application No. PCT/EP2017/071100 filed Aug. 22, 2017, and claims the benefit thereof. The International Application claims the benefit of German Application No. DE 10 2016 217 672.2 filed Sep. 15, 2016. All of the applications are incorporated by reference herein in their entirety.

FIELD OF INVENTION

The invention relates to a single-shaft turbo compressor, comprising—a rotor extending along an axis, —an outer housing, —static flow fittings, —a bearing for supporting the rotor, —at least one first shaft seal, the rotor having a shaft and impellers arranged on the shaft, the static flow fittings including supply elements, intermediate guide elements and discharge elements, the outer housing having a first end-face cover, a second end-face cover and a casing part which is undivided in the peripheral direction, extends in the axial direction in the manner of a pipe and is open at the end on both sides, the outer housing being formed in such a way that a radially outer periphery of the first cover, when ready for operation, from the inside of the outer housing, is in contact with a radially inwardly protruding step extending in the peripheral direction, a first rotor end being guided through an axial first opening of the first cover, and a gap between the rotor and the first cover being sealed on the feedthrough by means of the first shaft seal.

BACKGROUND OF INVENTION

Single-shaft turbo compressors having a barrel design are already known from WO2016042004-A1 and WO2016026825-A1.

Single-shaft turbo compressors having a barrel design in which a radially outer periphery of the first cover, when ready for operation, from the inside of the outer housing, is in contact with a radially inwardly protruding step extending in the peripheral direction, are already known from WO2016041841-A1.

A housing for a single-shaft turbo compressor having a barrel design is already known from WO2016041800-A1.

An assembly method for a single-shaft turbo compressor having a barrel design is already known from WO2015158905-A1.

A seal for a cover of a housing of a single-shaft turbo compressor having a barrel design is already known from WO2012038398-A1.

Supply lines which extend through housing parts and end-face housing covers are already known from DE 696 29 615 T2 and DE 10 2008 013433 A1.

Single-shaft turbo compressors are relatively complex to assemble, in particular when—as in the case of the design as radial compressors, which is advantageous according to the invention—the outer housing is designed without a parting line for relatively high pressures. Barrel housings of this type must be provided with the corresponding fittings through an end-face insertion opening along an axial insertion direction. The fittings include in particular static flow fittings and rotating flow fittings or the rotor comprising the corresponding impellers. In particular in the case of the radial design, this means that a substantially fully pre-assembled insert consisting of the rotating and the static flow guide elements is axially inserted in the barrel-shaped outer housing. In this case, the static and rotating flow fittings must be fixed to one another and supported against one another to produce a transportable unit. In addition, in the case of a horizontal orientation during the insertion of this transportable unit, the first rotor end which leads the insertion movement must be supported together with the static flow guide elements attached thereto. Such an insert is also frequently referred to as a cartridge. The horizontal insertion direction is advantageous because a vertical insertion into the barrel housing in the vertical direction requires a very large amount of space and requires a suitably high crane to be available, which is normally not provided in a machine hall for such an application.

Such assembly efforts arise not only for the first assembly but also as part of maintenance work. In this respect, reasonable assembly concepts substantially determine the marketing chances of such a machine. In addition to the problems which are outlined only superficially here, additional difficulties arise during assembly, for example when sealing elements between the outer housing and the insert can be slightly damaged during assembly.

Another set of problems from the prior art arises as a result of connections which connect for example shaft seals to supply or disposal lines for example for seal gas or extractions, which must also frequently be designed to be correspondingly separable so that an assembly and disassembly can take place without destroying the connections. The dimensions of the flanges used here and the number of these supply lines frequently leads to additional space being required in the radial direction in the region of the rotor ends so that the housing can be constructed to be larger in part than would actually be required by the thermodynamic/flow-related task of the machine.

SUMMARY OF INVENTION

Proceeding from the problems and disadvantages of the prior art, the invention addresses the problem of developing a machine of the type defined at the outset in such a way that a simplification of the assembly and maintenance work is to be achieved.

To solve the problem according to the invention, it is proposed to develop the single-shaft turbo compressor of the type defined at the outset.

The single-shaft turbo compressor according to the invention is advantageously a single-shaft radial turbo compressor. In principle, the invention is also suitable for axial compressor designs, but the large pressure ratios which can be achieved with radial compressors are particularly expedient for the barrel design of the outer housing.

For particularly high pressures, the barrel design provided according to the invention comprising the casing part and the end-face covers is thus particularly useful, because then the casing part does not tend towards nonuniform deformations over the periphery, and therefore no leaks are caused by said deformations. The end-face first cover, which, at least on one side, from inside the casing structure of the housing, is in axial contact with a peripheral step, is therefore particularly advantageous because only fasteners which have to withstand only relatively small differences in pressure have to be provided to secure the cover in this position because, in the operating state, in the case of a high excess pressure inside the outer housing, the first cover is pressed against the contact surface in the outer housing by the inner excess pressure without additional fastening means having to be provided for this purpose. In one advantageous embodiment of the invention, the first cover is held in position only by lugs which are attached from outside to the cover and optionally to the housing so that for example the cover stays in position should negative pressure arise in the suction region of the turbomachine. The contact pressure, which also increases as the excess pressure increases, of the first cover on this inner peripheral step or the contact surfaces of the casing structure of the outer housing further ensures particularly good sealing by means of the seals which are advantageously in axial contact therewith.

Advantageously, on the first cover, exclusively axially acting seals are provided, so that as part of the insertion of the flow fittings into the outer housing, a radial displacement of the outer housing relative to the flow fittings cannot cause any defect to said seal as a result of unintentional radial contacts.

Expediently, the static flow fittings which are arranged in the outer housing include supply elements, intermediate guide elements and discharge elements. In this case, the supply elements supply the process fluid entering the outer housing through an inlet opening to the rotating flow guide elements and the intermediate guide elements for the purpose of sealing.

Downstream of the supply elements, the process fluid flows through the intermediate guide elements—that is to say rotating flow guide elements—or impellers and corresponding stationary flow guide elements which are in the form of what are known as return stages in the case of the radial design. These stationary flow guide elements—which, in the case of the radial design, are referred to as return stages—are also referred to here as intermediate guide elements.

After flowing through all the impellers or return stages, the process fluid reaches the flow-guiding components, referred to in the terminology of the invention as discharge elements, which supply the process fluid to a flow outlet out of the outer housing. In this case, the discharge elements are regularly designed in such a way that the accelerated process fluid is decelerated, and accordingly a pressure build-up takes place (according to Bernoulli's principle). The discharge elements generally include a diffuser, a collection chamber and a collection coil. The process fluid opens out of the discharge elements downstream generally into an outlet flange out of the outer housing and into a pipeline for further transport.

According to the invention, supply lines and discharge lines for supplying the shaft seals are provided so as to extend through the first cover into a wall thickness of the casing part adjoining the first cover and from there, open out in each case into a connecting flange, the connecting flange being rigidly connected to the casing part. In this way, the connecting flanges are arranged on a greater diameter so that, in principle, more installation space is available for the arrangement thereof and the further connection thereof. Accordingly, the first cover can be formed with a smaller diameter without having to consider the dimensions of the connecting flanges. Thus, based on the flow-related—thermodynamic requirements with respect to the radial installation space thereof, the entire machine can be optimized or made smaller. This newly opened-up degree of freedom of the design, in addition to the material savings, can also lead to gains in terms of efficiency as a result of the flow-related optimization.

To reduce the diameter of the first cover as much as possible so that sealing diameters can also be reduced in the interest of simplifying seals, it can be advantageous for the casing part to comprise a radially inwardly extending portion on the axial end face of the first cover, which portion goes beyond the wall thickness of the casing part of the other axial extension in such a way that the step with which the first cover is in contact emerges from inside, and the radial extension goes inwardly beyond the radial extension of the connecting flanges attached to the casing part. Within the meaning of the invention, it is particularly expedient for the first cover to comprise at least one shaft seal stator part, or for a shaft seal stator part of a first shaft seal to be rigidly attached or detachably attached to the cover. Particularly expediently, the first shaft seal can be attached to the first cover as a common insert composed of a shaft seal stator part and a shaft seal rotor part, a simultaneous attachment to the rotor being particularly useful so that a common transportable unit is produced in conjunction with the static flow fittings.

A particularly advantageous development of the invention provides that the first cover comprises a radially inwardly protruding step extending in the peripheral direction, with which the first shaft seal is in contact axially from outside so that the first shaft seal can be removed from outside. Although the first cover is in contact with an inwardly protruding step of the casing part of the outer housing and, in this way, ensures a sealing closure of the outer housing, it is advantageous for the shaft seal itself to be in sealing contact from axially outside with a step, extending in the peripheral direction, of the cover so that said shaft seal can be easily removed as part of maintenance work. As a result of the significantly smaller diameter of the outer contour of the shaft seal in comparison with the cover, to attach the shaft seal to the first cover, only fasteners that are not as large as comparable fasteners for the first cover would have to be if they were attached to the casing-shaped outer housing from outside are required. Accordingly, the modularity of the cover comprising the shaft seal and the outer housing casing ensures firstly a saving in space and secondly particularly simple maintenance work. For logical reasons, the shaft seals for the first cover and/or the first cover relative to the casing part of the outer housing are provided in each case with an axially acting seal so that it is unlikely that damage will occur in the course of the assembly.

Another advantageous development of the invention provides that the first cover has a modular structure so that it can be disassembled into a central part and an annular part which surrounds the central part in a substantially concentric manner, in such a way that the annular part comprises the radially outer periphery of the first cover for contact with the step, which extends in the peripheral direction, of the outer housing, and the central part is in sealing contact from outside with an outwardly protruding second step extending in the peripheral direction on a corresponding contact surface of the annular part.

Another advantageous development of the invention provides that supply lines and discharge lines of the first shaft seal extend through the first cover—namely through the central part and through the annular part—into a wall thickness of the casing part adjoining the first cover.

BRIEF DESCRIPTION OF THE DRAWINGS

In the following, the invention will be described in greater detail on the basis of a specific exemplary embodiment with reference to schematic drawings in longitudinal section, in which.

DETAILED DESCRIPTION OF INVENTION

Terms such as axial, radial, tangential or similar expressions always relate to a central axis unless indicated otherwise.

The descriptions of the drawings generally relate to multiple drawings if elements are described which have a general application. If reference is made to specific elements which are shown in individual drawings, reference is made to the specific drawing. Accordingly, in the various drawings, like components having the same function are provided with the same reference signs.

FIG. 1-8 are each a schematic, longitudinal sectional view of a single-shaft turbo compressor STC.

The single-shaft turbo compressor STC comprises a rotor R extending along the axis X, which has a shaft SH and impellers IMP (only referred to by way of example) arranged on the shaft SH. An outer housing OC is provided with a first end-face cover CV1 and a second end-face cover CV2 for sealing a casing part BC of the outer housing OC. The covers CV1, CV2 have openings OP1, OP2 through which respective ends of the rotor R extend. The rotor R is radially supported by means of bearings BG or radial bearings, an axial bearing BGA holding the rotor R in a specific axial position.

The casing part BC is positioned on a base unit SUP with a horizontally extending axial direction along an axis X. The casing part BC has an inflow INL, an existing outflow not being visible in the schematic representation. A process fluid PF flows (in the operation not shown here) through the inflow INL and would be accelerated or sealed in operation by the static flow fittings SFE and the rotating flow fittings RFE so that overall, the pressure of the process fluid PF is increased.

Figure 1:
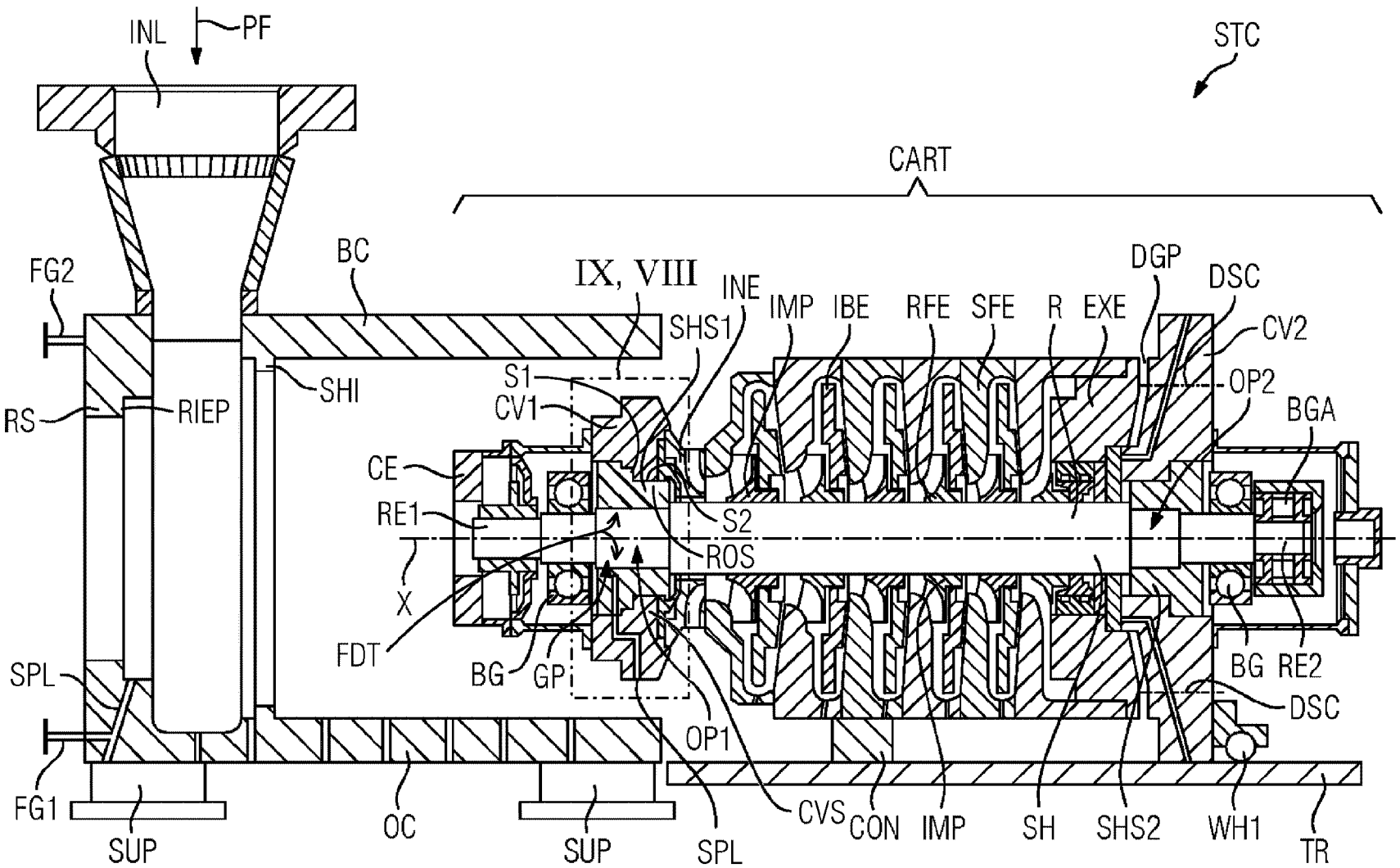
FIGS. 1 to 7 are each a schematic longitudinal section along the shaft axis of a single-shaft turbo compressor in different component combinations or assembly or disassembly phases.

The single-shaft turbo compressor STC in FIG. 1 is in a first assembly phase, in which a casing part BC, which is open at the end on both sides, of an outer housing OC is not yet assembled together with the rest of the single-shaft turbo compressor STC. The rest of the single-shaft turbo compressor STC includes static flow fittings SFE and rotating flow fittings RFE. In this phase of the assembly, according to the invention, advantageously a bundle CART comprising—static flow fittings SFE, —rotating flow fittings RFE or the rotor R, the shaft SH, —end-face covers CV1, CV2 of an outer housing OC, —bearings BG, BGA, —shaft seals SHS1, SHS2 is advantageously axially inserted into the casing part BC, which is open at the end on both sides, of the outer housing OC.

In the case of the assembly phase shown in FIG. 1, the above-described bundle CART (or cartridge)—that is to say an assembly composed of the rotor R, the static flow fittings SFE, the first cover CV1 and a second cover CV2 on the side of a first rotor end RE1 or second rotor end RE2 and shaft seals SHS1, SHS2 provided on both sides (shaft seals SHS1, SHS2 for sealing a peripheral gap GP on the respective feedthroughs FDT of the rotor ends RE1, RE2 through the openings OP1 and OP2), the bearings BG, BGA are axially inserted in the casing part BC of the outer housing OC. For the sake of simplicity of illustration, in FIG. 1 the letters FDT are just shown in connection with the first cover CV1. During this insertion process, the assembly in the form of a transportable unit is supported in an axially movable manner in a rail TR by means of a first wheel WH1 and a console CON.

The second cover CV2 is arranged at a distance of an axial gap DGP from axially adjacent discharge elements EXE of the bundle CART by means of spacers DSC. In this exemplary embodiment, the spacers DSC are a plurality of axially extending screws which are screwed into the second cover CV2 from outside and, axially against the pull of the shaft SH centrally tensioning the bundle CART under pressure axially by means of the centering component CE and the axial bearing BGA, keep the second cover CV2 at a distance from the discharge elements EXE.

Figure 2:
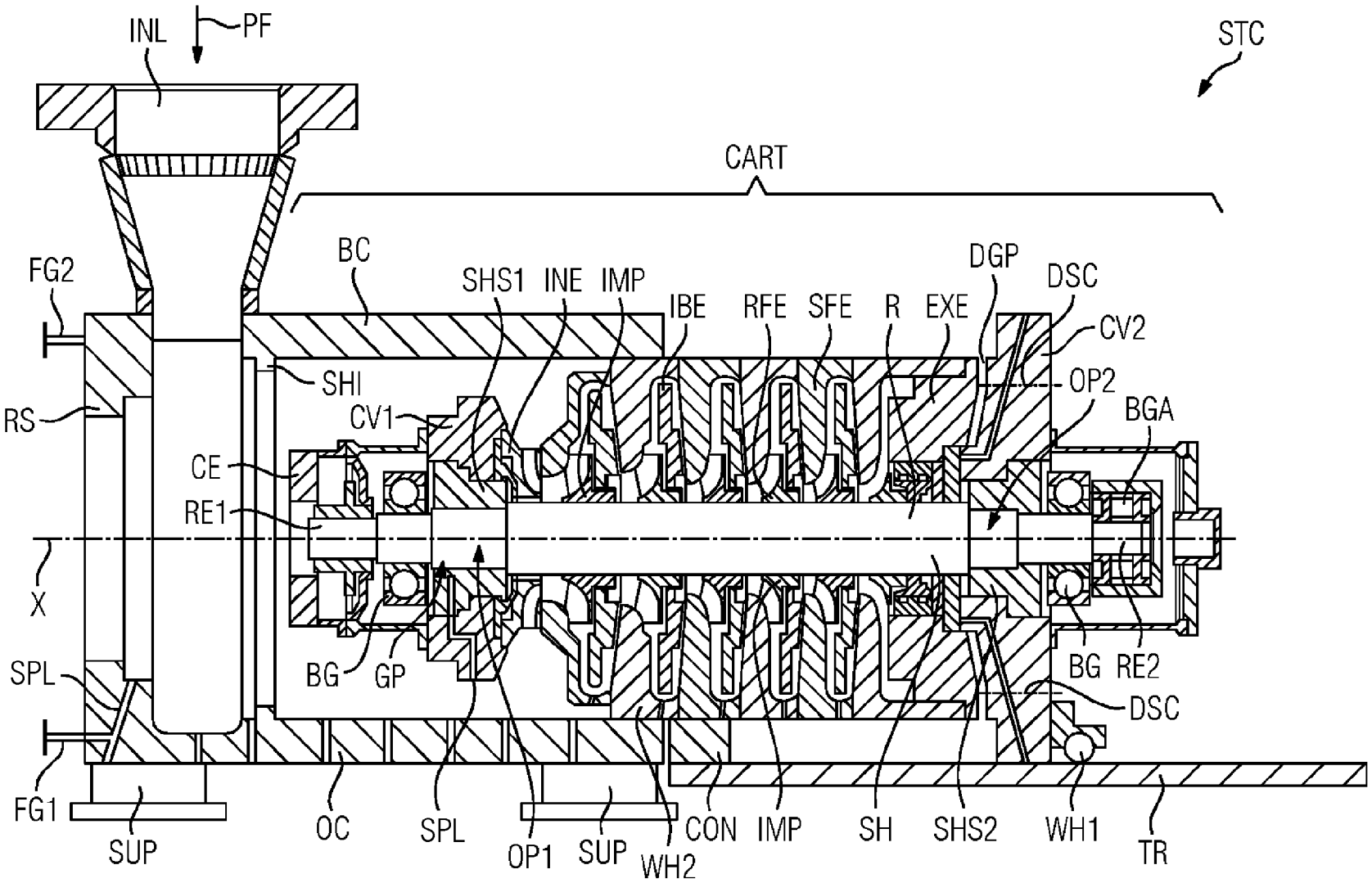

In FIG. 2, this bundle is already inserted further into the outer housing OC.

In the second phase of the assembly shown in FIG. 2, the console CON is detached from a second wheel WH2, which comes into contact with an inner surface of the casing part BC and there axially guides the bundle so as to further engage in the outer housing.

Figure 3:
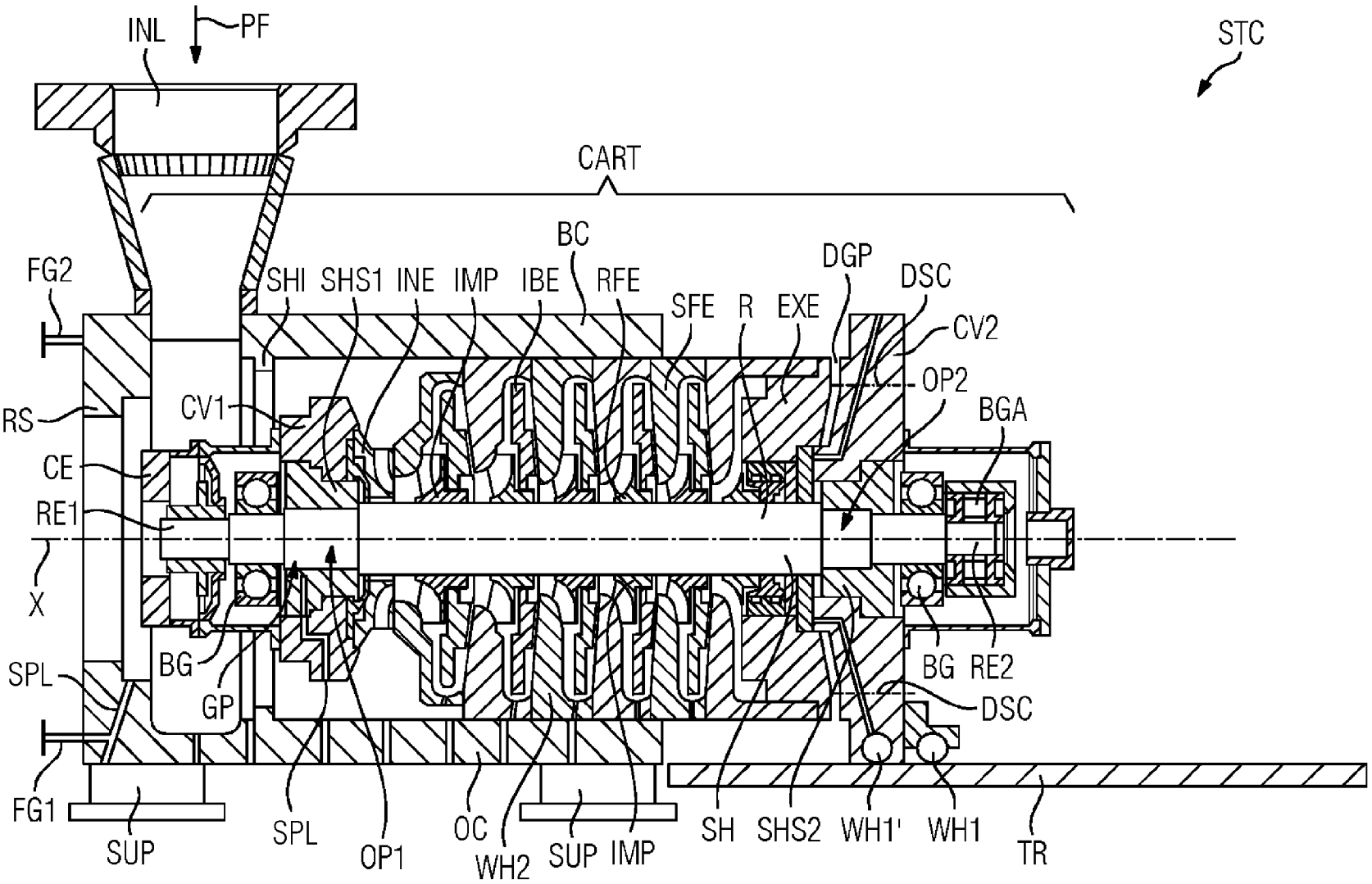

FIG. 3 shows the additional axial engagement of the assembly in the casing part BC of the outer housing OC, in addition to the first wheel WH1, another first wheel WH1' being shown as an addition or alternative. The first wheel WH1 is part of a separate part attached to the second cover CV2 which can be disassembled after assembly has taken place, and the other first wheel WH1' is in the form of an integral part of the second cover CV2. The other first wheel WH1' can remain on the second cover CV2 during the operation of the single-shaft turbo compressor STC. The additional other first wheel WH1' allows a simpler axial displacement of the second cover without the rest of the bundle CART.

Figure 4:
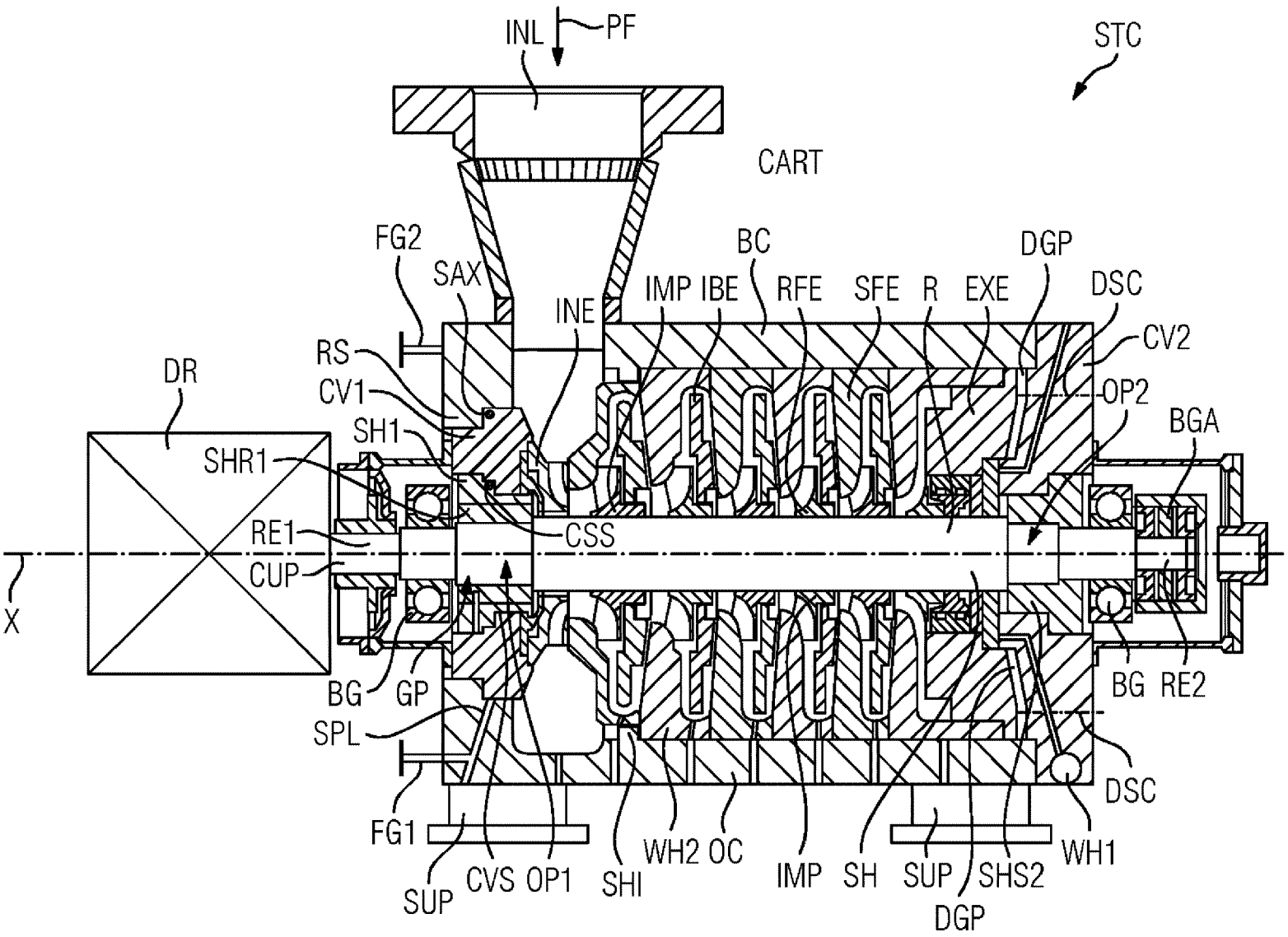

In the assembly phase shown in FIG. 4, the assembly consisting of the rotor, the covers CV1, CV2, the static flow fittings SFE including supply elements INE, intermediate guide elements IBE and discharge elements EXE is completely engaged in the casing part BC of the outer housing OC. As a result of the spacers DSC, the bundle CART reaches an abutment shoulder SHI which protrudes radially inwardly in the casing part BC in an axial sealing manner sooner than the second cover CV2 comes to rest against an end face of the casing part BC. The spacers DSC are then set back or removed so that the second cover CV2 also rests against the casing part BC.

At the same time, the centering component CE for the axial orientation or tensioning of the rotor R relative to the first cover CV1, which in FIG. 1-3 is shown by the reference sign CE, has been removed so that a coupling CUP provided on the side of the first rotor end RE1 can be used to attach a drive DR.

The supply element INE holds the rotor R substantially coaxially with the static flow fittings SFE during the assembly.

Whereas the second cover CV2 is already located in the axial end position in FIG. 4, and in this way, forms a seal, the first cover CV1 has not yet come into axially sealing contact and is axially moved into the end position only by increasing the axial distance from the supply element INE so that an axially acting seal SAX comes into sealing contact between the casing part BC and the first cover CV1. A first shaft seal SHS1 and SHS2 which is attached and sealingly applied to the first cover CV1 and to the second cover CV2 rests axially from outside against an inwardly protruding step of the respective cover CV1, CV2 so that, for maintenance purposes, the respective shaft seal SHS1, SHS2 can be pulled off axially outwards when the axially adjoining components such as bearing BG or coupling CUP have been removed beforehand.

At least the first cover CV1 has supply lines SPL and discharge lines EXL of the first shaft seal SHS1 which are provided so as to extend through the first cover CV1 into a wall thickness of the casing part BC adjoining the first cover CV1 and from there, open out in each case into a connecting flange FG1, FG2, which is rigidly connected in each case to the casing part BC. A static seal CSS is provided for axial contact between the first cover CV1 and the first shaft seal SHS1. The first cover CV1 comprises a radially inwardly protruding step CVS extending in the peripheral direction, with which the first shaft seal SHS1 is in contact from axially outside so that the first shaft seal SHS1 can be removed from outside. That is, the first end-face cover CV1 has protruding step CVS defined by a first surface S1 (FIG. 1) extending radially inwardly. Protruding step CVS is further defined by a second surface S2 (FIG. 1) orthogonal to the first surface and extending axially away from the first rotor end RE1 and positioned to abut a radially outward surface ROS of the first shaft seal SHS1. This arrangement permits removability of the first shaft seal SHS1 through the first rotor end RE1. Each connecting flange FG1, FG2 is attached to the casing part at a respective axial end face thereof. The protruding step RS of the casing part BC has a radially inwardly extending portion RIEP (FIG. 1) abutting an axial end face of the first end-face cover CV1, as may be appreciated in the assembly phase shown in FIG. 4.

The first shaft seal SHS1 comprises (analogously to the second shaft seal) a shaft seal rotor part SHR1 and a shaft seal stator part SH1, which are designed to be mountable as a common insert on the first cover CV1 and/or the rotor R.

Figure 5:
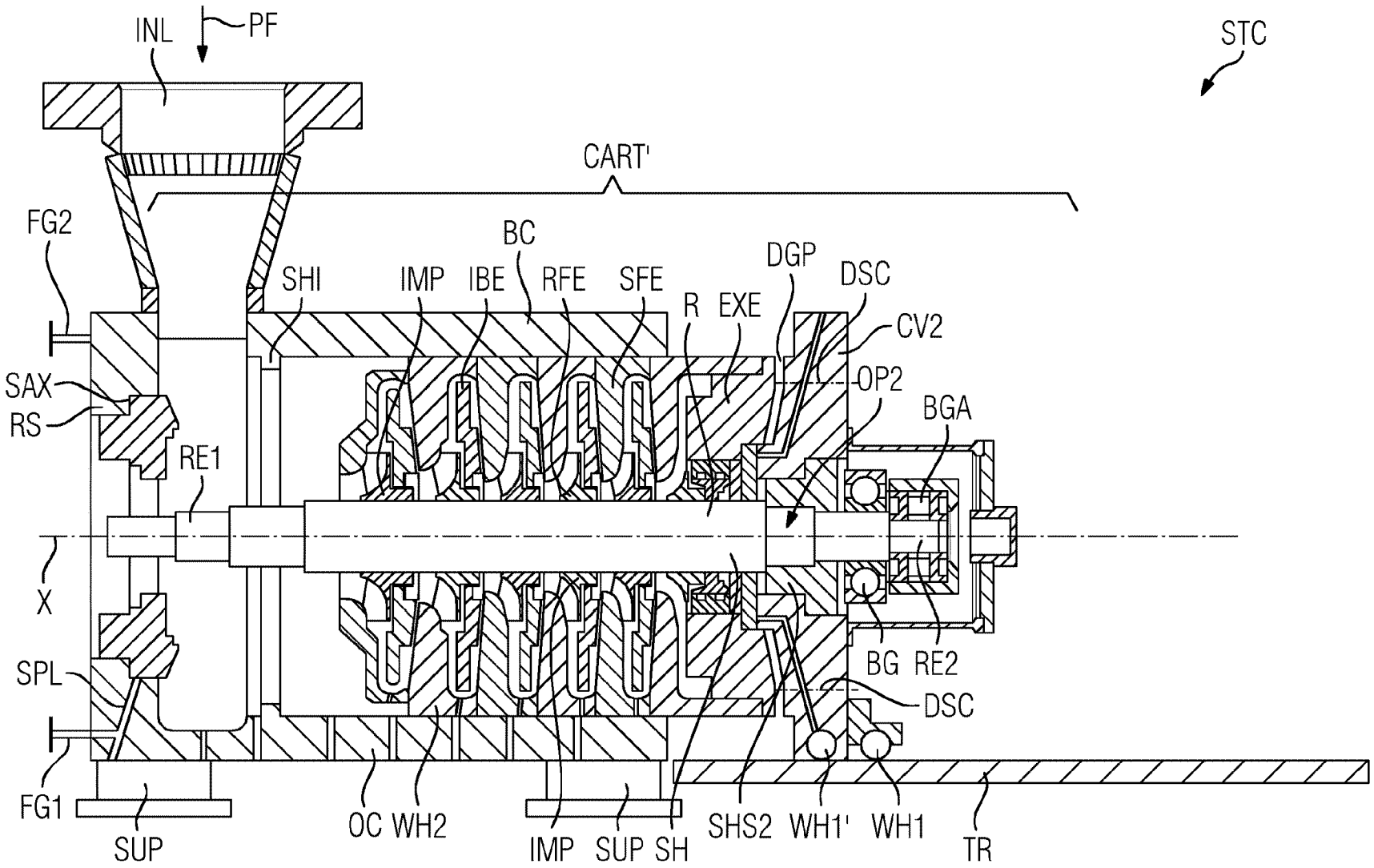

FIG. 5 shows the state of the single-shaft turbo compressor STC in the phase of a disassembly, for example for maintenance purposes. A reduced bundle CART' is axially disengaged at least in part from the outer housing OC. With respect to the original bundle CART, the reduced bundle CART' is reduced by the supply elements INE, the first shaft seal SHS1 and the bearing BG on the first shaft end RE1. FIG. 5 shows that the bundle CART can also be moved as a reduced bundle CART' independently of these different components so that these high-maintenance different components conversely can also be machined without having to axially move the bundle CART or reduced bundle CART'.

Figure 6:
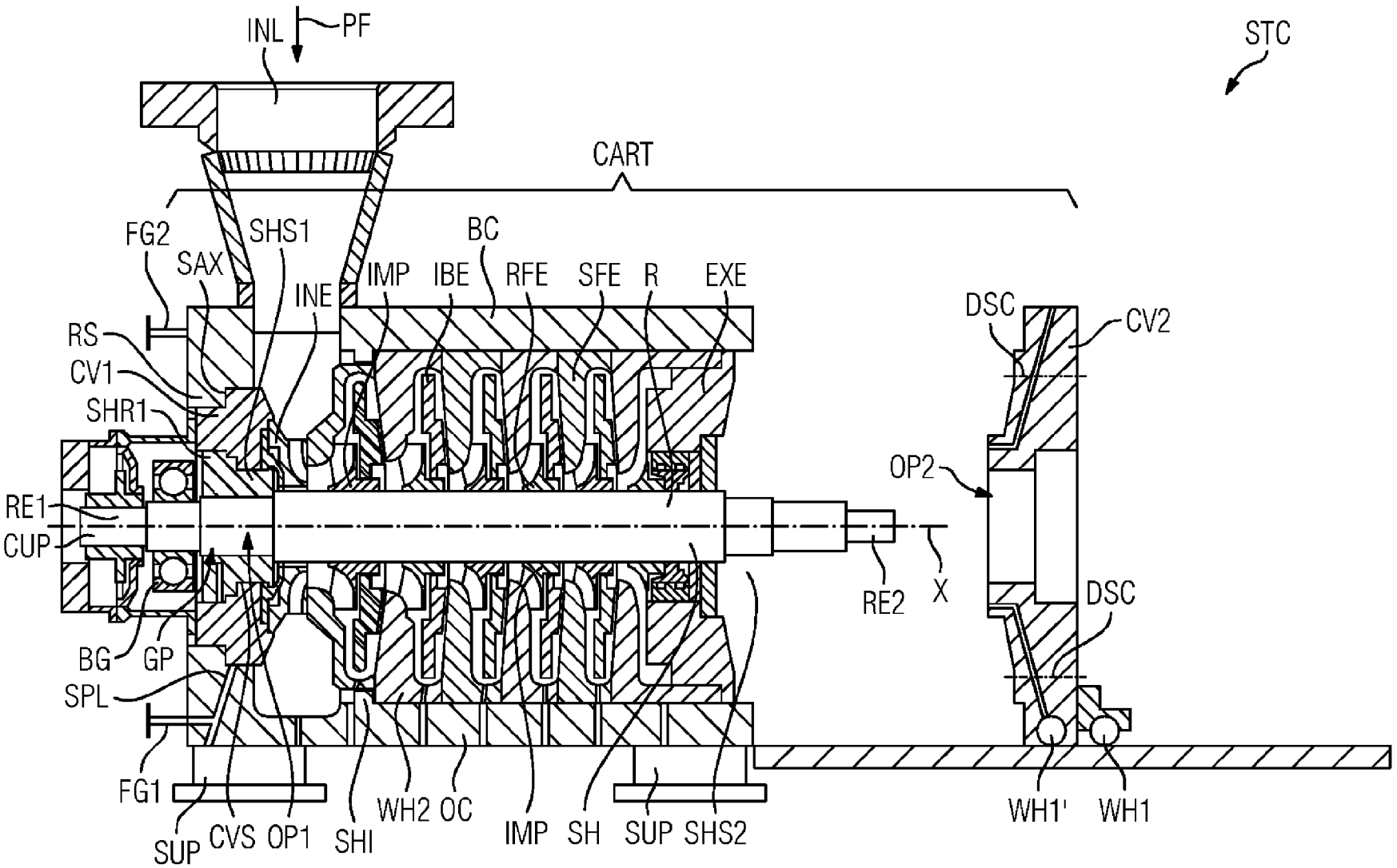
Figure 7:
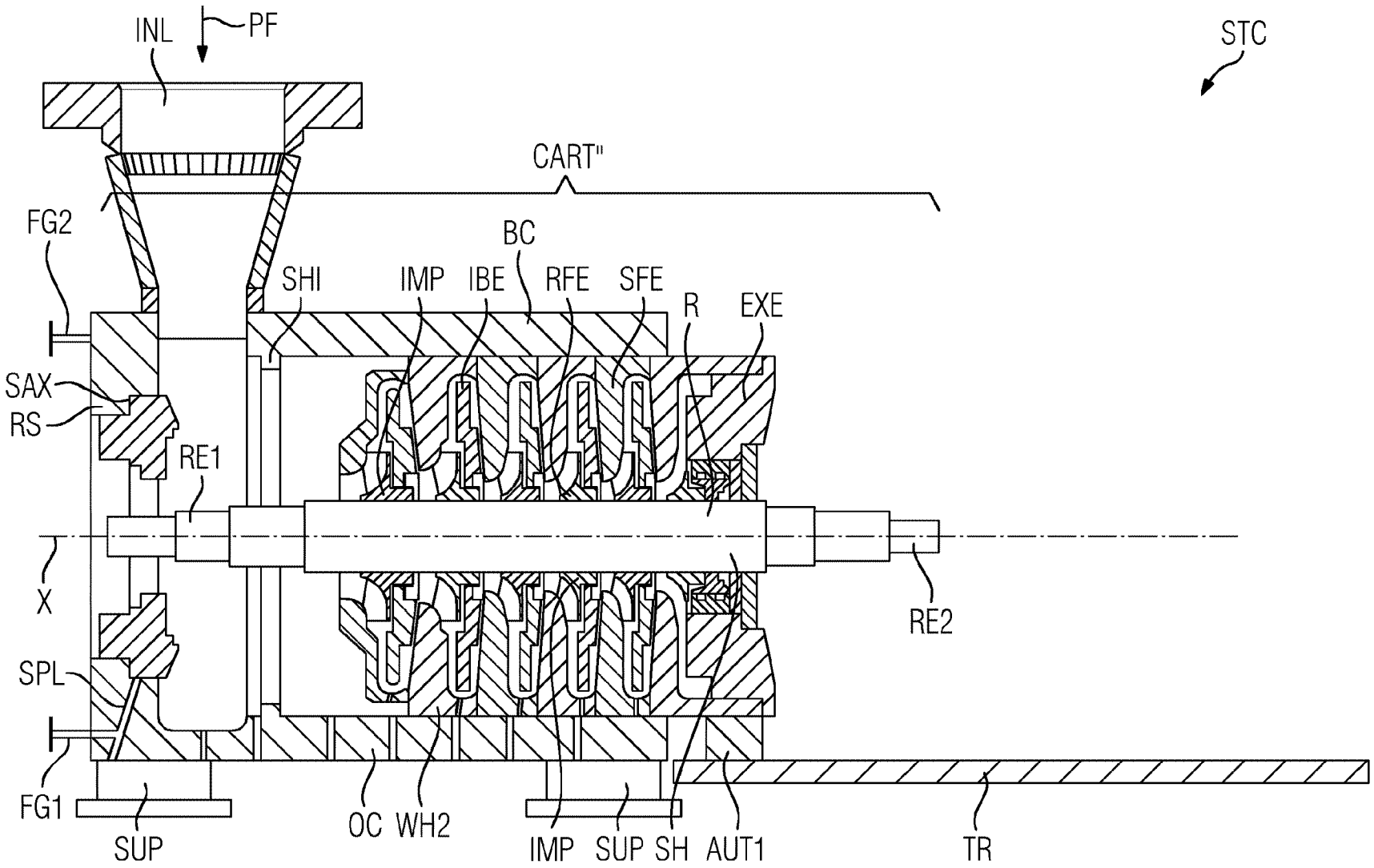

FIG. 6 moreover shows that, without moving the complete bundle CART, the second cover CV2 can be axially removed from the assembly so that in the region of the shaft seal, bearings and other components, maintenance work can be carried out with little effort. FIG. 7 shows that even when the first cover CV1 is removed, the remaining bundle CART' can be axially moved out of the outer housing OC by an additional auxiliary tool AUT1.

Figure 8:
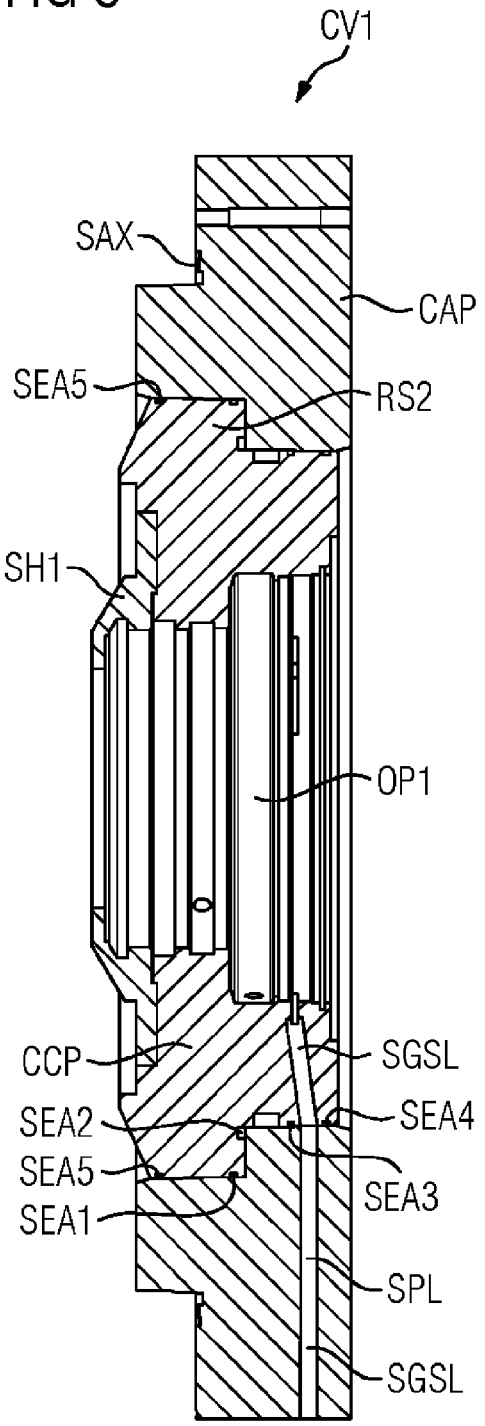
FIGS. 8 and 9 are each a schematic longitudinal section of a detail VIII and IX respectively which is shown in FIG. 1, the sectional planes of the views being offset from one another rotated about the axis X.
Figure 9:
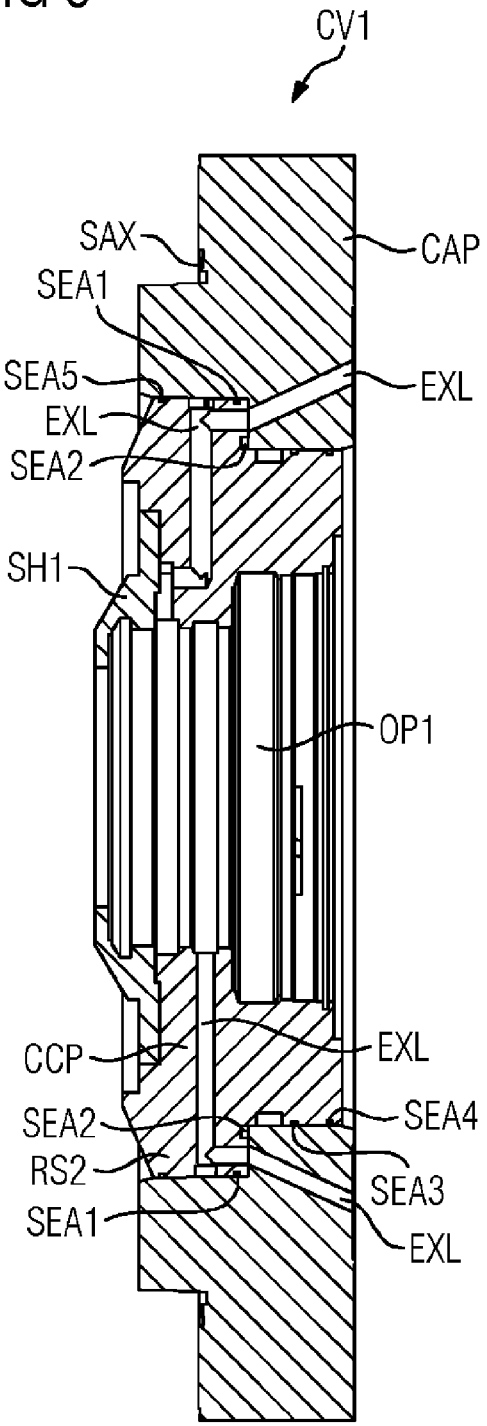

FIGS. 8 and 9 each show a detail designated by VIII and IX respectively in FIG. 1 in a different orientation of the axial plane of the longitudinal section or for different peripheral positions. In this case, the view is a mirror image of FIG. 1.

The first cover CV1 shown in FIGS. 8 and 9 has a first opening OP1 for guiding through the shaft SH with the rotor end RE up, which is surrounded by a central part CCP of the first cover CV1. The central part CCP is concentrically surrounded by an annular part CAP of the first cover CV1. The first shaft seal SHS1 is inserted in the central part CCP so as to surround the first opening OP1 and is supplied with seal gas by means of supply lines SPL, the supply line SPL extending radially through the annular part CAP and the central part CCP as far as the first shaft seal SHS1. In FIG. 9, a similar element is shown for the discharge line EXL which, proceeding from the first shaft seal SHS1, extends through the central part CCP and subsequently through the annular part CAP. The annular part CAP has a radially outer periphery which is provided for the contact of the first cover CV1 with the step RS, extending in the peripheral direction, of the outer housing OC. The central part CCP has an outwardly protruding second step RS2 extending in the peripheral direction, which is in sealing contact with a corresponding contact surface of the annular part CAP from outside.

In this manner, it is possible, when the annular part CAP remains, to disassemble the central part CCP including the first shaft seal SHS1 and to accordingly subject said central part to maintenance work. This element is shown in FIGS. 5 and 7, in which the annular part CAP remains on the outer housing OC. The junctions between the annular part CAP and the central part CCP in the region of the supply lines SPL and discharge lines EXL are each sealed with respect to one another and to the surroundings by means of peripheral seals SEA1, SEA2 and SEA3, SEA4, SEA5 so that in each case one gap region extending in the peripheral direction between the central part CCP and the annular part CAP is under the pressure of the corresponding supply line SPL or discharge line EXL.

The invention claimed is:

1. A single-shaft turbo compressor, comprising:

a rotor extending along an axis, an outer housing, a bearing for supporting the rotor, and a first shaft seal, wherein the rotor has a shaft and impellers arranged on the shaft, wherein the outer housing has a first end-face cover, a second end-face cover and a casing part having a periphery which is undivided, wherein the casing part extends in an axial direction and is open at both ends, wherein the casing part of the outer housing has a protruding step extending radially inwardly, wherein a radially outer periphery of the first end-face cover abuts the protruding step of the casing part, a first rotor end being guided through an axial first opening of the first end-face cover, and a gap between the rotor and the first end-face cover being sealed on a feedthrough of the shaft by the first shaft seal, wherein the first end-face cover is connected to the first shaft seal, wherein the first shaft seal is fluidly connected by way of one or more lines that extend through the first end-face cover, a wall thickness of the casing part adjoining the first end-face cover, a connecting flange connected to the wall thickness of the casing part, and wherein the first end-face cover has a protruding step defined by a first surface extending radially inwardly, the protruding step of the first end-face cover further defined by a second surface orthogonal to the first surface and extending axially away from the first rotor end and positioned to abut a radially outward surface of the first shaft seat, wherein the protruding step of the first end-face cover permits removability of the first shaft seal through the first rotor end.

2. The single-shaft turbo compressor as claimed in claim 1, wherein the single-shaft turbo compressor comprises static flow fittings which are arranged in the outer housing, wherein the static flow fittings include supply elements, intermediate guide elements and discharge elements.

3. The single-shaft turbo compressor as claimed in claim 1, wherein the connecting flange is attached to the casing part at an axial end face thereof, wherein the protruding step of the casing part comprises a radially inwardly extending portion abutting an axial end face of the first end-face cover.

4. The single-shaft turbo compressor as claimed in claim 1, wherein the first shaft seal is attached to the first end-face cover, wherein the first shaft seal comprises a shaft seal rotor part and a shaft seal stator part, which are designed to be mountable as a common insert on the first end-face cover and/or the rotor.

5. The single-shaft turbo compressor as claimed in claim 2, wherein a static seal is provided for axial contact between the first end-face cover and the first shaft seal.

6. The single-shaft turbo compressor as claimed in claim 5, wherein the first end-face cover is attached to the supply elements.

7. The single-shaft turbo compressor as claimed in claim 6, wherein the supply elements are attached to the intermediate guide elements.

8. The single-shaft turbo compressor as claimed in claim 7, wherein the intermediate guide elements are attached to the discharge elements.

9. The single-shaft turbo compressor as claimed in claim 8, wherein the second end-face cover is radially centered on the discharge elements.

10. The single-shaft turbo compressor as claimed in claim 8, wherein the rotor comprises a coupling on an axial side of the first end-face cover for connecting a drive.

11. The single-shaft turbo compressor as claimed in claim 1, wherein the first end-face cover has a modular structure so that it can be disassembled into a central part and an annular part which surrounds the central part in a substantially concentric manner, wherein the annular part comprises a radially outer periphery of the first end-face cover for contact with the protruding step of the casing part, and wherein the central part is in sealing contact with an outwardly protruding second step which extends on a corresponding contact surface of the annular part.

12. The single-shaft turbo compressor as claimed in claim 11, wherein the one or more lines comprise supply lines and discharge lines.

13. The single-shaft turbo compressor as claimed in claim 12, wherein the supply lines and the discharge lines extend through the central part of the first end-face cover and through the annular part into the wall thickness of the casing part adjoining the first end-face cover.

* * * * *